US005755951A

United States Patent [19]

Kröner et al.

[11] Patent Number: 5,755,951

[45] Date of Patent: May 26, 1998

[54] REGENERATION OF PLASTIC DIAPHRAGM

[75] Inventors: Rudi Kröner, Mannheim; Bernd Leutner, Frankenthal; Hans-Michael Schneider, Worms; Holger Friedrich, Bad Dürkheim; Kurt Hecky, Zeiskam; Dieter Schläfer, Ludwigshafen; Wolfgang Steiner, Friedelsheim, all of Germany

[73] Assignee: BASF Aktiengesellschaft, Ludwigshafen, Germany

[21] Appl. No.: 876,250

[22] Filed: Jun. 16, 1997

Related U.S. Application Data

[63] Continuation of Ser. No. 656,481, May 31, 1996, abandoned.

[30] Foreign Application Priority Data

May 31, 1995 [DE] Germany ..... 195 19 921.9

[51] Int. Cl.[6] ..... C25B 15/00; C25B 11/20

[52] U.S. Cl. ..... 205/525; 204/282; 134/3; 134/28; 134/42

[58] Field of Search ..... 205/525; 204/282; 134/3, 28, 42

[56] References Cited

U.S. PATENT DOCUMENTS

| | | | |
|---|---|---|---|
| 1,309,214 | 7/1919 | Moore . | |
| 3,930,979 | 1/1976 | Vallance | 204/252 |
| 3,988,223 | 10/1976 | Hirozawa | 204/98 |
| 4,174,269 | 11/1979 | Carlin et al. | 204/129.95 |
| 4,204,921 | 5/1980 | Britton et al. | 204/98 |
| 4,381,230 | 4/1983 | Burney, Jr. et al. | 204/98 |
| 5,133,843 | 7/1992 | Eisman | 204/105 R |
| 5,498,321 | 3/1996 | Arnold et al. | 205/525 |

FOREIGN PATENT DOCUMENTS

| | | |
|---|---|---|
| 694 632 | 1/1996 | European Pat. Off. . |
| 1567962 | 4/1966 | Germany . |
| 19 56 291 | 6/1970 | Germany . |
| 60077985 | 10/1983 | Japan . |
| 739261 | 9/1978 | U.S.S.R. . |
| 808561 | 9/1978 | U.S.S.R. . |

*Primary Examiner*—Arun S. Phasge

*Attorney, Agent, or Firm*—Keil & Weinkauf

[57] ABSTRACT

A process for the regeneration of plastic diaphragms is described, in which a mineral acid solution is mixed with a suitable corrosion inhibitor, this mixture is temperature controlled at from approximately 0° to 100° C., preferably 40° to 80° C., in particular 50° to 70° C., and passed through the diaphragm for from approximately 0.1 to 84 hours, preferably 1 to 72 hours, in particular 2 to 24 hours.

19 Claims, No Drawings

REGENERATION OF PLASTIC DIAPHRAGM

This application is a continuation of application Ser. No. 08/656,481, filed on May 31, 1996 now abandoned.

The present invention relates to a process for the regeneration of plastic diaphragms, in particular for the regeneration of plastic diaphragms from alkali metal chloride electrolysis.

In alkali metal chloride electrolysis, the diaphragm process employs electrolysis cells which use a cathode grid made of iron, to which the diaphragm material has been applied, eg. by vacuum deposition. The anodes used today are generally dimensionally stable anodes (DSA) which are, for example, expanded metal grids made of titanium, which are coated with ruthenium oxide/titanium oxide. After incorporation into the cell, the anodes are expanded in order to keep the distance between anode and cathode and thus the ohmic voltage drop as low as possible.

In the diaphragm process, diaphragms of different materials are used, for example of asbestos. Recently, plastic diaphragms, have also been used, which are prepared by vacuum deposition of a fibrous material and subsequent sintering. The fibrous material can consist, for example, of PTFE fibers containing embedded and adhering $ZrO_2$ particles. Examples of such a fibrous material are Polyramix® fibers (Oxytech) and Tephram® fibers (PPG Industries, Inc.).

In comparison with asbestos diaphragms, the plastic diaphragms can be operated for far longer. While an asbestos diaphragm typically has a lifetime of from approximately 4000 to 10,000 operating hours and is then replaced, plastic diaphragms can be employed over a time of from approximately 17,000 to 26,000 operating hours. During this longer operating time, it can now occur that iron compounds which are contained in the trace range (<1 ppm) in the brine (NaCl solution) are deposited, on account of the considerable gradient of the hydrogen ion concentration (pH) in the diaphragm, as oxide (for example $Fe_2O_3$, $Fe_3O_4$) not only on the diaphragm as in the case of the asbestos diaphragm, but even grow through the plastic diaphragm in the form of veins or needles. These intergrowths consist of a conductive iron oxide. These conductive intergrowths result in it being possible after a certain time (approximately after from 1 to 3 years) for hydrogen to evolve on the anode side of the diaphragm. Owing to the increase in the hydrogen content of the chlorine, there is the danger, after exceeding the explosive limits, of a chlorine detonating gas explosion. For safety reasons, the cell must therefore be switched off in the case of greatly increased hydrogen concentrations. Owing to the evolution of hydrogen on the anode side, the purity of the chlorine additionally falls, which is also undesirable.

Besides the iron deposits, calcium, strontium and in some cases magnesium deposits can also occur, which lead to reduced permeability or blockage of the diaphragm.

In the case of asbestos diaphragms, on account of the shorter operating time, the intergrowths do not occur as in the case of the plastic diaphragms. For the removal of the surface deposits on asbestos diaphragms, it is proposed, for example in U.S. Pat. No. 1,309,214, to wash the asbestos diaphragms with dilute lactic acid. By this means, gelatinous deposits of magnesium hydroxide and/or calcium hydroxide which block the diaphragm can indeed be removed also without corroding the iron parts or iron cathode, but the iron oxide intergrowths in plastic diaphragms cannot be dissolved out in this way.

DE 19 56 291 proposes to remove blockages of diaphragms by rinsing the diaphragm with hydroxypolycarboxylic acids, such as citric acid, gluconic acid etc. This process also is indeed suitable partially to remove surface deposits of iron oxides, but the dissolving-out of iron oxide intergrowths in plastic diaphragms is not possible in this way.

In Soviet Offenlegungsschrift SU 808561 a process for the washing of asbestos diaphragms is described in which, during electrolytic operation, hydrochloric acid is added to the cathode space and the pH is lowered to 7. By means of this process also, surface deposits and blockages of asbestos diaphragms can indeed be eliminated, but iron intergrowths cannot be eliminated satisfactorily. The process described is additionally uneconomical, as relatively large amounts of the useful product sodium hydroxide solution are neutralized and thus destroyed. SU 964024 therefore proposes to employ a clean sodium chloride solution and to remove the sodium carbonates beforehand. As the intergrowths in the diaphragms are especially caused by specific iron salts which are contained in the brine in only very small amounts, a further reduction of the iron concentration in the brine would be connected with considerable economical expenses.

In order to regenerate plastic membranes or diaphragms, it is proposed in U.S. Pat. No. 5,133,843 to clean these with aqua regia. Noble metal-containing deposits, in particular, can be removed by this process. The diaphragm can indeed be cleaned by this process, but during the course of this all iron parts in the electrolysis cell, for example the cathode, are destroyed. The diaphragm would thus have to be dismantled and removed from the cathode for cleaning. Cleaning of the diaphragm in the alkali metal chloride electrolysis cell would thus not be possible.

Even Japanese Patent Application JP 60077985, which describes a process for the cleaning of electrolysis cells of the diaphragm type, which are used in particular for the preparation of hydrogen from alkalis, with mixtures of acids and surfactants, is only employable for the cleaning of a dismantled asbestos diaphragm, as here also the corrosion of the iron and titanium parts cannot be avoided.

German Offenlegungsschrift 15 67 962 describes a process for to the regeneration of an asbestos diaphragm in which a corrosion inhibitor is used for protection of the iron parts. Even according to this process, only surface deposits can be removed, whereas intergrowths of the diaphragm cannot be dissolved out. As asbestos as a material is not stable under strongly acidic conditions, the corrosion inhibitors proposed in the Offenlegungsschrift for protection of the cathode during the regeneration of a plastic diaphragm are also inadequate. Titanium corrosion can additionally not be prevented by this process.

U.S. Pat. No. 3,988,223 describes the cleaning of plastic diaphragms made of Nafion® or Gore-Tex® using complexing agents such as EDTA (ethylenediaminetetraacetic acid) or ethylenediaminetetrapropionic acid. The proposed complexing agents are comparatively expensive compounds. On account of the complexing agents contained therein, the rinsing solution obtained in the cleaning of the diaphragm cannot be added untreated to the waste water, so that additional costs mount up for the laborious disposal.

On account of the difficulties in the prior art, customarily, for regeneration of the plastic diaphragm of the cell, this is completely removed and replaced by a new one. This procedure is cost-intensive, as the re-equipping of the cell necessitates extensive work and the new diaphragm material necessary for this purpose is very expensive. Additionally, landfill costs for the material which has become unusable mount up. Cleaning of the plastic diaphragm must completely remove the iron impurities, as otherwise after regeneration a fall of the hydrogen concentration in the chlorine cannot be permanently achieved. As the age-hardened iron oxides, in particular, are deposits and intergrowths which adhere very persistently and are difficult to dissolve, the use of agents is necessary which, on the other hand, can lead to corrosion of iron and titanium parts in the cell.

It is therefore the object of the present invention to provide a process for the regeneration of plastic diaphragms, in which deposits and/or intergrowths on or in the plastic diaphragm can be removed economically, in particular without iron and/or titanium parts corroding significantly and without residues which are difficult to dispose of resulting. This object is achieved according to the present invention by the subject matter defined in the independent patent claims; advantageous embodiments are mentioned in the subclaims.

In particular, this object is achieved by a process for the regeneration of plastic diaphragms in which a mineral acid solution is mixed with a corrosion inhibitor and the mixture thus obtained is passed through the plastic diaphragm at from approximately 30° to 110° C., preferably 40° to 80° C., in particular 50° to 70° C., for from approximately 0.1 to 84 hours, preferably 1 to 72 hours, in particular 2 to 24 hours. This process, on the one hand, provides a possibility of removing even stubborn, poorly soluble and intergrown iron deposits, and, on the other hand, of being able to carry out the regeneration of the plastic diaphragm in situ without having to dismantle the diaphragm, as sufficient protection of the iron and titanium parts can be achieved. Otherwise, dismantling of the diaphragms in the case of the preferred cell construction is not possible without destroying the diaphragms. The plastic diaphragms are therefore preferably regenerated in the cell. Regeneration in the electrolysis cell saves time, costs and expenditure of labor.

Preferably, a process is provided in which the mineral acid solution is employed in a concentration of from 0.3 to 20% by weight, in particular from 2 to 10% by weight. The use of an acid which consists at least partially, preferably exclusively, of hydrochloric acid, as a mineral acid is particularly preferred. The use of hydrochloric acid avoids foreign ions passing into the cell, which would then have to be removed again by prolonged rinsing. In principle, another mineral acid, for example sulfuric acid, would of course also be suitable for carrying out the cleaning.

In a further preferred process, the mineral acid solution contains up to 250 g/l of sodium chloride. The admixture of sodium chloride increases the cleaning action of this mixture. It is thus possible, for example, when adding NaCl to decrease the concentration of the hydrochloric acid (e.g. from 9% to 2%), the solution then nevertheless still having an adequate cleaning action.

In another preferred process of the present invention, from 0.005 to 5% by weight, preferably 0.05 to 0.5% by weight, of corrosion inhibitor is provided in the mixture of the mineral acid solution with the corrosion inhibitor, the percentage by weight data being based on the mixture of the mineral acid solution with the corrosion inhibitor as 100% by weight. This dose of the corrosion inhibitor leads to a protection of the iron parts in the electrolysis cell.

In a further preferred process of the present invention, a corrosion inhibitor is used which contains at least one alkynol. Preferably, a corrosion inhibitor can also be used which contains at least one alkynol and is preferably mixed with from 1 to 25% by weight of an amine and/or 0.1 to 3% by weight of a surfactant, the percentage by weight data being based on the corrosion inhibitor as 100% by weight. These alkynols can be, for example, alkynediols, such as butynediol, 3-hexyne-2,5-diol, 3,6-dimethyl-4-octyne-3,6-diol, 2,5-dimethyl-3-hexyne-2,5-diol, or else alternatively propargyl alcohol or hexynol (3-hexyn-2-ol) or ethynylcyclohexanol. Amines, for example hexamethylenetetramine, ethylhexylamine, diethylhexylamine or other primary, secondary or tertiary amines, can be added to these alkynols. The alkynols act here as a monomer for the formation of a corrosion-inhibiting coating on the iron parts which are to be protected.

In a preferred process of the present invention, a surfactant is used which contains a quaternary ammonium compound. Organic ammonium compounds having quaternary nitrogen atoms can include, for example, quaternary ammonium compounds, in particular having long alkyl chains, for example distearyldimethylammonium chloride (DSDMA), Protectol KLC 80® or Protectol KLC 50® (BASF) or Pluradyne CI 1066® (BASF Corp.). Particularly preferred mixtures of alkynols with amines and/or quaternary ammonium compounds comprise approximately 98% butynediol and 2% hexamethylenetetramine or, for example, approximately 97.8% butynediol plus approximately 2% hexamethylenetetramine plus approximately 0.2% Protectol KLC 50®.

In a further preferred process of the present invention, the mineral acid solution contains from approximately 500 to 5000 ppm of copper or iron salts. Preferably, water-soluble Fe(III) or Cu(II) salts are added to the mixture of the mineral acid solution and the corrosion inhibitor. This can be achieved, for example, by additionally admixing, for example, iron chloride to the mixture of the mineral acid solution with the corrosion inhibitor, or by recirculating the mixture of the mineral acid solution with the corrosion inhibitor through the diaphragm. The iron-containing deposits dissolved out of the diaphragm in this case yield $Fe^{3+}$ compounds which then act as corrosion inhibitor with respect to the titanium, of which, in particular, the anodes contain relatively large amounts in uncoated form. A further advantageous process of the present invention proposes that the diaphragm is additionally rinsed, in particular rerinsed, with water and/or a sodium chloride solution. The water employed is preferably pure water. The rerinsing of the diaphragm rinses out residues of acid or hydrochloric acid, iron salts etc. Advantageously, a sodium chloride solution is used for this rinsing, as in this case during the subsequent filling of fresh brine into the cell the danger of uncontrolled dilution by residual water does not exist. Additionally, the cell is filled with fresh brine anyway.

In an additional process of the present invention, the alkynols used are also alkynemonools, in particular propargyl alcohol or ethynylcyclohexanol, an alkynol preferably being used in a concentration of greater than 30% by weight, typically in a concentration of greater than 80% by weight. The percentage by weight datum is based in this case on the total alkynols used as 100% by weight. These corrosion inhibitors are more effective with respect to prevention of the corrosion of iron. They can preferably be employed where cells are used in which anodes are provided which are completely coated with a ruthenium/titanium oxide layer. The addition of iron salts can also be dispensed with in this case. Effective corrosion inhibitors are mixtures which contain alkynemonools, for example propargyl alcohol or ethynylcyclohexanol, as the main component. These corrosion inhibitors are particularly suitable for use in mixtures which contain no dissolved iron salts. The mixture of mineral acid solution with the corrosion inhibitor should in this case only be used once. A preferred mixture for the inhibition of iron corrosion comprises, for example, a mixture of approximately 2% Protectol KLC 80®, approximately 1% ethynylcyclohexanol, approximately 8% ethylhexylamine or diethylhexylamine, and approximately 89% propargyl alcohol. A further advantageous mixture comprises approximately 2% Pluradyne CI 1066® and approximately 98% propargyl alcohol.

In a further preferred process of the present invention, the mixture is passed through an electrolysis cell without prior dismantling of diaphragm and electrode. In this way, it is thus possible to regenerate the diaphragm without having to dismantle it. Such an insitu cleaning of the diaphragm saves time, costs and expenditure of labor. More expensive dismantling of the diaphragm from the cell and removal of the diaphragm material is therefore no longer necessary.

Moreover, an advantageous process can be provided according to the present invention for the regeneration of plastic diaphragms, a process as described above being used several times in succession or at least two processes as described above being used in succession. By the use of this process in succession, the diaphragms can thus be used successively, for example, with different mixtures of mineral acid solutions containing various corrosion inhibitors at different temperatures for a different length of time, it being possible to combine the advantages of the individual process parameters in each case such that the optimum combination of individual processes and process parameters is provided for the contamination present. The individual processes or process steps can also be separated from one another by the rinsing of the diaphragm with a rinsing solution, in particular with pure water or a sodium chloride solution. The present invention is intended to be illustrated in greater detail with the aid of the following examples, in which further preferred features and combinations of features or embodiments of the invention are described.

EXAMPLE 1

An alkali metal chloride cell in whose anode gas a high hydrogen concentration (>4% by volume) had been measured was switched off and the solution therein drained. An 8% strength hydrochloric acid which contained 0.2% by weight of Korantin BH® (corrosion inhibitor of BASF AG based on butynediol and hexamethylenetetramine) was then preheated to 40° C. and pumped into the cell on the anode side. After the cell had been completely filled, further solution was pumped in, removed on the cathode side, and fed back to the storage container. This process was continued for 24 hours, the temperature of the hydrochloric acid being kept at 50° C.

Pieces of titanium electrodes immersed in the mixture of the hydrochloric acid and of the corrosion inhibitor showed no weight loss. Pieces of iron cathodes likewise immersed showed a weight loss of about 1% after 24 hours.

After termination of the regeneration, the acid was drained and the electrolysis cell was charged with fresh brine. The electrolysis of this brine yielded chlorine which contained less than 0.2% by volume of hydrogen.

EXAMPLE 2

An alkali metal chloride electrolysis cell was switched off and the solution therein drained. After this, the diaphragm was rinsed at 70° C. with an aqueous solution of approximately 2% strength hydrochloric acid, approximately 250 g/l of sodium chloride, approximately 0.5% Korantin BH and approximately 0.1% $Fe^{3+}$ ions for 2 hours. After this, the diaphragm was rerinsed with pure water for approximately one hour.

The weight decrease of the iron cathode was from 0.5 to 1.5% by weight, and the titanium corrosion was less than 0.02% weight decrease. The iron-containing deposits were completely removed from the diaphragm, ie. to over 98%.

EXAMPLE 3

The solution was drained from a switched-off alkali metal chloride electrolysis cell. After this, the diaphragm was rinsed at 70° C. for approximately 2 hours with an aqueous solution which contained approximately 8% hydrochloric acid, 0.5% Korantin BH® and approximately 0.1% $Fe^{3+}$ ions. In a second step, the diaphragm was rinsed at 50° C. for 24 hours with an aqueous solution which contained approximately 8% hydrochloric acid, approximately 0.5% Korantin BH® and approximately 0.1% $Fe^{3+}$ ions. The diaphragm was then rerinsed with pure water for approximately one hour.

The weight decrease of the iron cathode was from 1 to 2% by weight and the titanium corrosion was less than a 0.02% weight decrease. The iron-containing deposits were completely removed from the diaphragm, ie. to over 98%.

Using the present invention, a process for the regeneration of plastic diaphragms has thus been provided which is not only able to remove intergrowths of iron deposits in plastic diaphragms economically without corroding the iron and/or titanium parts, but also avoids residues which are difficult to dispose of from accumulating, which could pollute the environment.

We claim:

1. A process for the regeneration of plastic diaphragms, characterized in that a mixture of a mineral acid solution containing sodium chloride in an amount effective to increase the cleaning action of the mineral acid and a corrosion inhibitor is passed through the plastic diaphragm at from approximately 0° to 100° C., for from approximately 0.1 to 84 hours.

2. The process of claim 1, wherein the mineral acid solution is employed in a concentration of from 0.3 to 20% by weight.

3. The process of claim 1, wherein the mineral acid is hydrochloric acid.

4. The process of claim 1, wherein from 0.005 to 5% by weight of corrosion inhibitor is provided in the mixture of the mineral acid solution with the corrosion inhibitor, the percentage by weight data being based on the mixture of the mineral acid solution with the corrosion inhibitor as 100% by weight.

5. The process of claim 4, wherein from 0.05 to 0.5% by weight of corrosion inhibitor is provided in the mixture.

6. The process of claim 1, wherein the corrosion inhibitor contains at least one alkynol.

7. The process of claim 6, wherein the corrosion inhibitor contains at least one alkynyl and is mixed with from 1 to 25% by weight of an amine and 0.1 to 3% by weight of a surfactant, the percentage by weight data being based on the corrosion inhibitor as 100% by weight.

8. The process of claim 7, wherein the amine is selected from the group consisting of hexamethylenetetramine, ethylhexylamine and diethylhexylamine.

9. The process of claim 7, wherein at least one surfactant contains a quaternary ammonium salt.

10. The process of claim 6, wherein the alkynols also contain alkynemonools in a concentration of greater than 30% by weight, the percentage by weight datum being based on the total alkynols used as 100% by weight.

11. The process of claim 1, wherein the mineral acid solution contains from approximately 500 to 5000 ppm of copper compounds or iron compounds or mixtures thereof.

12. The process of claim 1, wherein the diaphragm is rinsed with water or with a sodium chloride solution or with both water and a sodium chloride solution.

13. The process of claim 1, wherein the mixture is passed through an electrolysis cell without prior dismantling of diaphragm and electrode.

14. A process for the regeneration of plastic diaphragms, wherein a process as defined in claim 1 is used several times in succession.

15. The process of claim 1, wherein the mixture is passed through the diaphragm at from about 50° to 70° C. for from about 1 to 72 hours.

16. The process of claim 15, wherein the mixture is passed through the diaphragm at for about 2 to 24 hours.

17. The process of claim 1, wherein the mineral acid solution is employed in a concentration of from 2 to 10% by weight.

18. The process of claim 1, wherein the mineral acid solution contains sodium chloride in an amount up to 250 g/l.

19. The process of claim 1, wherein the mixture is passed through the diaphragm at from about 40° to 80° C.

* * * * *